US005552857A

United States Patent [19]

Ishikawa

[11] Patent Number: 5,552,857

[45] Date of Patent: Sep. 3, 1996

[54] MULTICOLOR IMAGE FORMING APPARATUS

[75] Inventor: Tadashi Ishikawa, Ebina, Japan

[73] Assignee: Fuji Xerox Co., Ltd., Tokyo, Japan

[21] Appl. No.: 417,031

[22] Filed: Apr. 5, 1995

[30] Foreign Application Priority Data

May 16, 1994 [JP] Japan ..... 6-101335

[51] Int. Cl.[6] ..... G03G 15/00; G03G 15/01

[52] U.S. Cl. ..... 355/200; 355/326 R; 355/210; 355/327; 347/152

[58] Field of Search ..... 355/326 R, 327, 355/328, 200, 210, 211; 347/152, 153

[56] References Cited

U.S. PATENT DOCUMENTS 5,212,520 5/1993 Toyofuku ..... 355/200
5,475,484 12/1995 Kimura ..... 355/326 R

FOREIGN PATENT DOCUMENTS 62-299977 12/1987 Japan ..... 355/327 A
63-43173 2/1988 Japan ..... 355/327 A
63-301065 12/1988 Japan ..... 355/327 A
2-34869 2/1990 Japan ..... 355/326 A

*Primary Examiner*—Matthew S. Smith
*Attorney, Agent, or Firm*—Oliff & Berridge

[57] ABSTRACT

A multicolor image forming apparatus having a plurality of unicolor imaging units each equipped with at least a developing device anchored to a unit frame and an image carrier drum anchored removably to the unit frame with a predetermined space kept to a roll of the developing device. The unicolor imaging units are installed removably in the apparatus body while being supported respectively by means of slide rails attached to frames of the apparatus body, and toner images produced individually by the unicolor imaging units are transferred onto a recording medium to form a multicolor image. In this apparatus, a shaft fitter for fitting therein a shaft of the image carrier drum in each of the unicolor imaging units and a pin fitter for fitting therein an engagement pin infixed to project from the unit frame are provided respectively in a rear frame of the apparatus body and a support side plate anchored removably to a predetermined position of a front frame of the apparatus body, in such a manner that a predetermined space is kept between the shaft fitter and the pin fitter.

11 Claims, 6 Drawing Sheets

MULTICOLOR IMAGE FORMING APPARATUS

BACKGROUND OF THE INVENTION

1. Field of the Invention

The present invention relates to a multicolor image forming apparatus such as a copier or a printer adapted to form a multicolor image from toner images produced by a plurality of unicolor imaging units installed removably in the apparatus body.

2. Description of the Related Art

Regarding a multicolor image forming apparatus, there is recently proposed a type where a plurality of unicolor imaging units with photosensitive drums, developing devices and so forth incorporated integrally therein are installed removably in the apparatus body, and a full-color image is formed by successively transferring toner images, which are produced individually by such imaging units, to a recording paper transported by means of a conveyor belt or the like.

In such a multicolor image forming apparatus, it is essential to prevent a positional color deviation caused due to the process that forms a multicolor image by successively transferring individual toner images obtained from the plural imaging units and then superposing the toner images mutually on the recording paper. A variety of considerations need to be given for prevention of such color deviation, and particularly in the multicolor image forming apparatus of the type mentioned, the prime requisite is that the transfer positions in the entire imaging units are mutually constant. More specifically, the positional relationship among photosensitive drums in the imaging units and also among the individual drums should be retained constant in the apparatus.

However, the multicolor image forming apparatus mentioned has such a construction that photosensitive drums are incorporated removably in the unicolor imaging units respectively, and the unicolor imaging units themselves are installed also removably in the apparatus body while being supported by means of slide rails. Therefore, particularly when the imaging units are installed in the apparatus, the photosensitive drums may fail to be set exactly at predetermined positions in the apparatus. Accordingly it is necessary to adopt some adequate measures for precisely placing each drum in a fixed positional relationship to the apparatus body.

Besides the above, it is requisite in such unicolor imaging unit that a photosensitive drum and a roll of a developing device need to be spaced apart from each other with a proper gap required for development.

Practically, however, the gap for development is varied between the imaging units as well as in any single unit itself because of the construction where the photosensitive drums are anchored removably to unit frames in the stage of installation of the imaging units in the apparatus body, and also the imaging units are installed removably in the apparatus body while being supported by means of slide rails, and further due to the tolerances of individual component parts existing between the photosensitive drum and the developing device (roll). And such variation of the gap raises a problem that desired development fails to be performed properly to consequently cause some uneven image density in the individual imaging units for thereamong. The gap variation thus induced tends to worsen with an increase of the frequency of repeated installation and removal of the imaging units or the photosensitive drums.

Therefore, it has been necessary in the conventional apparatus to maintain the required dimensional precision of individual component parts and also the required high accuracy in assembling and attaching such component parts with utmost strictness and advanced skill for the purpose of retaining the gap constant between the photosensitive drum and the developing roll. In this case, however, there exist some problems including an increase in the production cost of the component parts and more difficulty in handling the same.

As a means for maintaining the gap constant between the photosensitive drum and the developing roll, there is known a technique of providing, at both ends of the roll, tracking members which project therefrom at a height equal dimensionally to the gap, and keeping such tracking members in contact with the surface of the photosensitive drum to retain the desired gap. However, in any imaging unit employing none of such means, maintenance of the desired gap for development is rendered further essential.

SUMMARY OF THE INVENTION

The present invention has been accomplished in view of the problems mentioned above. And an object of the invention resides in providing a multicolor image forming apparatus wherein a plurality of unicolor imaging units can be installed removably in the apparatus body with facility, and particularly in the stage of installation of such imaging units, image carrier drums and developing devices incorporated therein can be set at proper positions with ease and accuracy.

According to one aspect of the present invention, there is provided a multicolor image forming apparatus wherein a plurality of unicolor imaging units, each of which is equipped with at least a developing device anchored to a unit frame and an image carrier drum anchored removably to the unit frame in such a manner that a predetermined space is maintained between the drum and a roll of the developing device, are installed removably in the apparatus body while being supported by means of slide rails disposed in a frame of the apparatus body, and individual toner images produced by the plural unicolor imaging units are transferred onto a recording medium to thereby form a desired multicolor image. In this apparatus, a shaft fitter for fitting therein a shaft of the image carrier drum in each unicolor imaging unit and a pin fitter for fitting therein an engagement pin projecting from the unit frame are provided respectively in a rear frame of the apparatus body and a support side plate anchored removably to a predetermined position of a front frame of the apparatus body, in such a manner that a predetermined space is held between the two fitters.

The shaft fitter is provided in a region corresponding to a predetermined position where the image carrier drum is to be set finally in the apparatus body. And the pin fitter is provided with a predetermined space held to the shaft fitter so that the image carrier drum and the roll of the developing device are positioned with a desired development gap retained therebetween. In a modification, the shaft fitter and the pin fitter may be provided in the support side plate at a front position of the apparatus body instead of being provided directly in the rear frame, and thereafter the support side plate may be anchored to the rear frame of the apparatus body. It is defined here that the front position of the apparatus body signifies one side of the apparatus where the user is present, and the rear position of the apparatus body signifies the reverse side of the apparatus with respect to the front thereof.

The apparatus of the present invention is characterized in that the pin fitter in the above technical means consists of a pin fitting base and a pressure jig for pressing the fitting base toward the shaft fitter, and the pin fitting base of the pin fitter in the support side plate is formed into a cam mechanism rotatable for releasing the pressure from the jig. The pin fitting base of the cam mechanism is composed of a metallic material or a synthetic resin.

According to the above-described technical means, a plurality of unicolor imaging units are installed in the apparatus body through slide rails, and the support side plate is anchored to the front frame of the apparatus body, whereby the shaft of the image carrier drum in each imaging unit and the engagement pin of the unit frame are fitted respectively into the shaft fitter and the pin fitter which are provided in the rear frame of the apparatus body and the support side plate respectively. As a result, each image carrier drum is positioned properly in the apparatus body, and simultaneously the developing device is also positioned with respect to the image carrier drum thus positioned. And in this stage of the assembling process, the image carrier drum and the roll of the developing device are positioned with a predetermined space left therebetween.

Since the pin fitting base is pressed by the pressure jig, the unit frame of the engagement pin, i.e., the developing device, is also pressed toward the image carrier drum, so that the space between the image carrier drum and the roll for development can be held fixedly with enhanced certainty. And in installing each imaging unit to or removing the same from the apparatus body, such operation can be performed easily and simply by rotating the fitting base of the cam mechanism in the pin fitter of the support side plate to thereby release or apply the pressure from the jig.

The above and other features and advantages of the present invention will become apparent from the following description which will be given with reference to the illustrative accompanying drawings.

DETAILED DESCRIPTION OF THE PREFERRED EMBODIMENT

Figure 1:
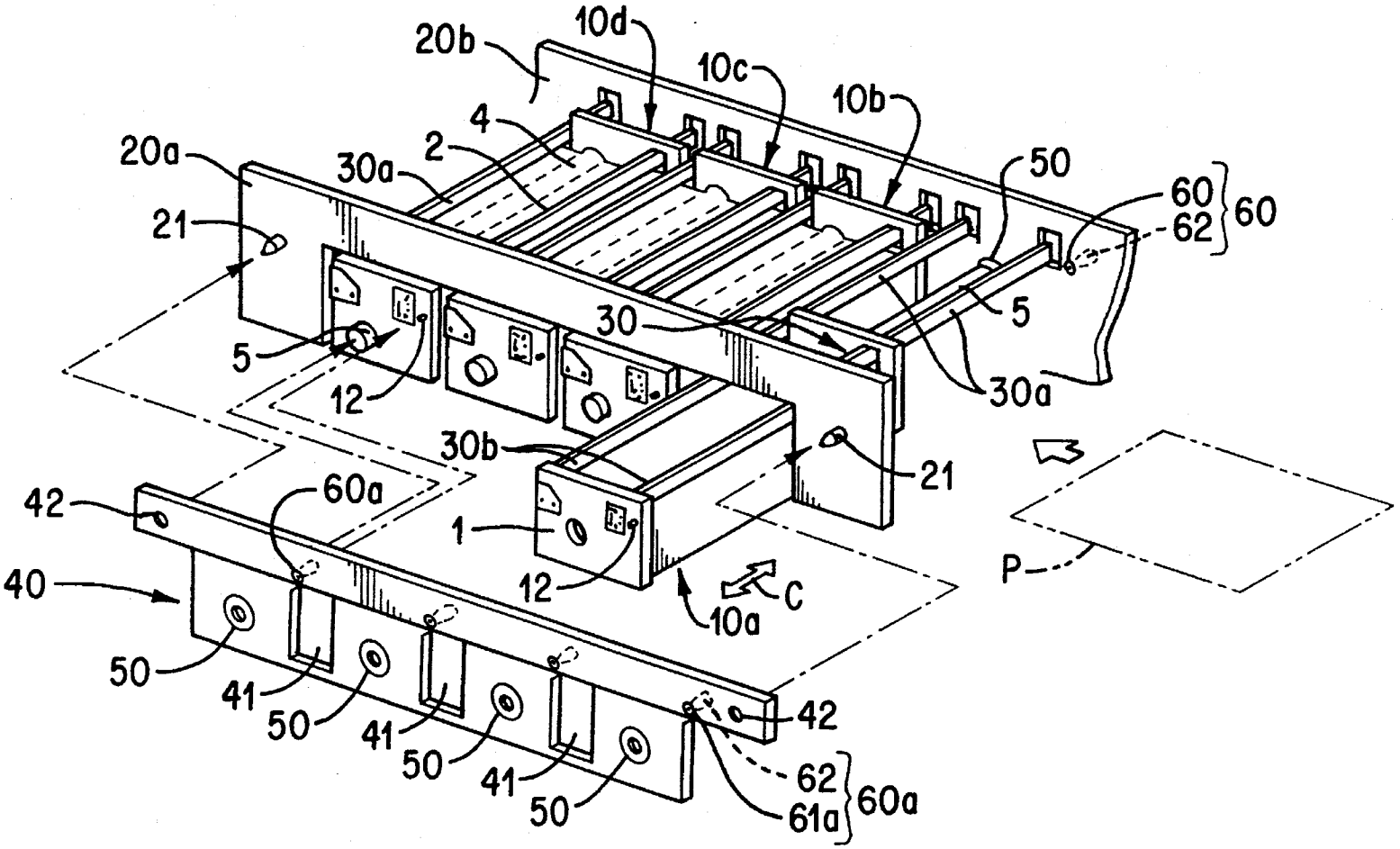
FIG. 1 is a partially exploded perspective view showing principal components in a multicolor image forming apparatus according to a preferred embodiment of the present invention.

Hereinafter an embodiment of the present invention will be described in detail with reference to the accompanying drawings, FIG. 1 shows principal components in a multicolor image forming apparatus according to a preferred embodiment of the invention, In FIG. 1, reference numerals 10*a* to 10*d* denote unicolor imaging units which produce a black toner image, a yellow toner image, a magenta toner image and a cyan toner image respectively in this order. There are also shown a frame 20 of an apparatus body including a front frame 20*a* and a rear frame 20*b*, and slide rails 30 slidable bidirectionally as indicated by an arrow C. The rails 30 consist of stationary rails 30*a* attached to the apparatus body frame 20 and movable rails 30*b* attached to the imaging units 10. There are further shown a support side plate 40 anchored removably to a predetermined position of the front frame 20*a*, and an opening 41 formed in accordance with the requirement.

Figure 2:
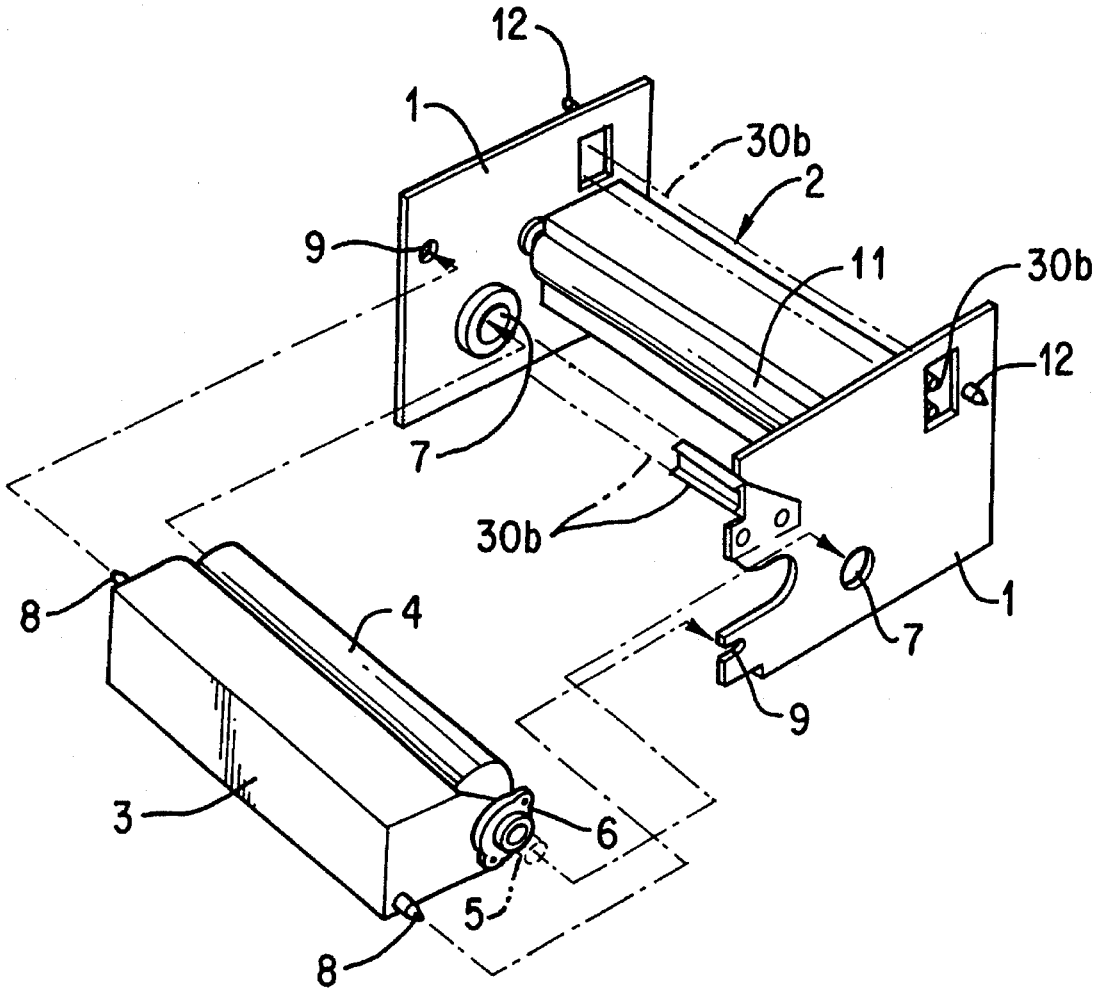
FIG. 2 is a partially exploded perspective view showing the construction of a unicolor imaging unit.

As illustrated in FIG. 2, each of the unicolor imaging units 10 principally comprises a unit frame 1, a developing device 2 joined fixedly to the unit frame 1, and a photosensitive drum 4 which is connected removably to the unit frame 1 and serves as an image carrier drum integrated with a cleaner 3.

The photosensitive drum 4 is connected, together with the cleaner 3, to the unit frame 1 as denoted by a one-dot chained line in FIG. 2. More specifically, the photosensitive drum 4 is connected in such a manner that first its shaft 5 is inserted and fitted into shaft fitting holes 7, which are formed in the unit frame 1, via brackets 6 and so forth furnished for bearing the shaft 5, and then positioning pins 8 fixed on outer wall faces of the cleaner 3 are fitted or locked in pin engaging recesses 9. And at the time of such connection of the photosensitive drum 4 to the unit frame 1, the drum 4 is disposed opposite to a development roll 11 of the developing device 2 with a predetermined adequate gap required for development.

The shaft 5 of the photosensitive drum 4 in this embodiment is anchored previously to the rear frame 20*b* of the apparatus body via a shaft fitter as shown in FIG. 1, and when the imaging unit is installed in the apparatus body, its shaft 5 is inserted into the shaft holes for the drum 4 to be thereby integrated with each other upon completion of the installation.

Engagement pins 12 are provided on the outer surfaces of the unit frame 1 in a manner to project outward therefrom. Although movable rails 30*b* of the slide rails 30 are attached to the unit frame 1, such movable rails 30*b* are partially denoted by two-dot chained lines in FIG. 2 for convenience.

Denoted by 50 in FIG. 1 is a shaft fitter into which the shaft 5 of the photosensitive drum 4 is fitted. Such shaft fitter 50 is provided in both of the rear frame 20 of the apparatus body and the support side plate 40 correspondingly to the position where the photosensitive drum 4 is to be disposed in the apparatus body. Particularly the shaft fitter 50 in the support side plate 40 is so positionally formed as to be opposite to the other shaft fitter in the rear frame 20 when the support side plate 40 is anchored to the apparatus body frame.

Denoted by 60 is a pin fitter for fitting therein the engagement pin 12 provided in the unit frame 1 of each imaging unit 10. Similarly to the above shaft fitter 50, this pin fitter 60 is provided in both of the rear frame 20 and the support side plate 40 correspondingly to the positions opposite to each other. The pin fitter 60 is formed in a region where, when the engagement pin 12 has been fitted therein, the roll 11 of the developing device 2 anchored to the unit frame 1 having the relevant engagement pin 12 is positioned with a predetermined development gap to the photosensitive drum 4 fitted into the shaft fitters 50.

Figure 3:
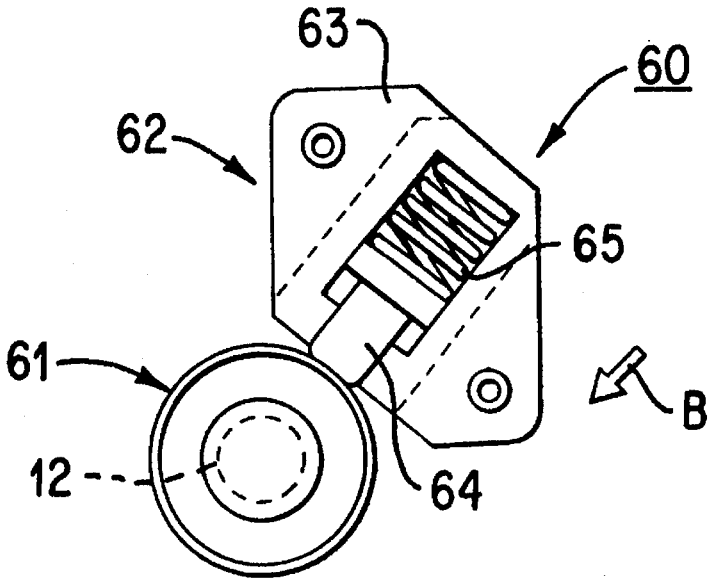
FIG. 3 is a front view of an exemplary pin fitter.

As illustrated in FIG. 3, the pin fitter 60 consists of a pin fitting base 61 with a cavity into which the engagement pin 12 is actually inserted, and a pressure jig 62 for pressing the fitting base 61 toward the shaft fitter 50. The pressure jig 62 comprises a jig housing 63 to be anchored to the apparatus body frame 20 or the support side plate 40, a push rod 64 slidable in a predetermined direction within the housing 63, and a coil spring 65 for resiliently urging the push rod 64 in a direction indicated by an arrow B.

Figure 4:
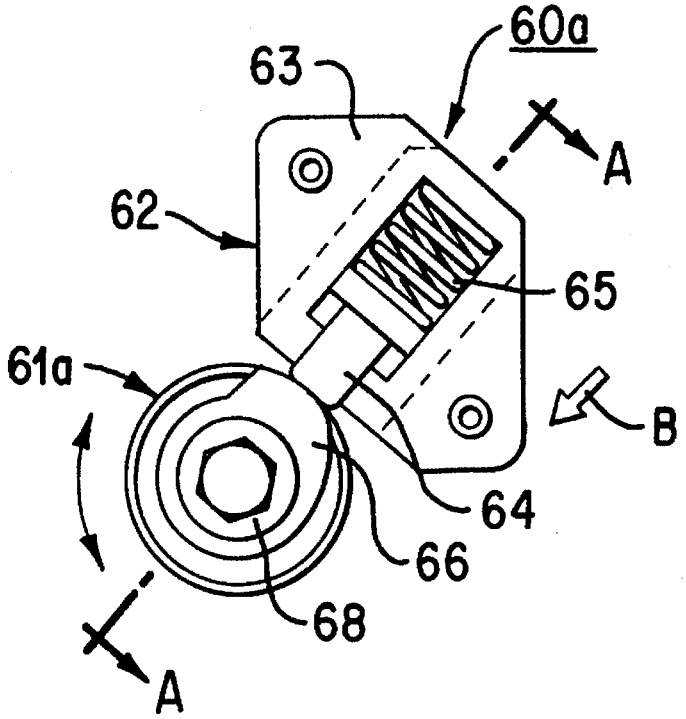
FIG. 4 is a front view of another exemplary pin fitter (in a pressed state) provided in a support side plate.
Figure 5:
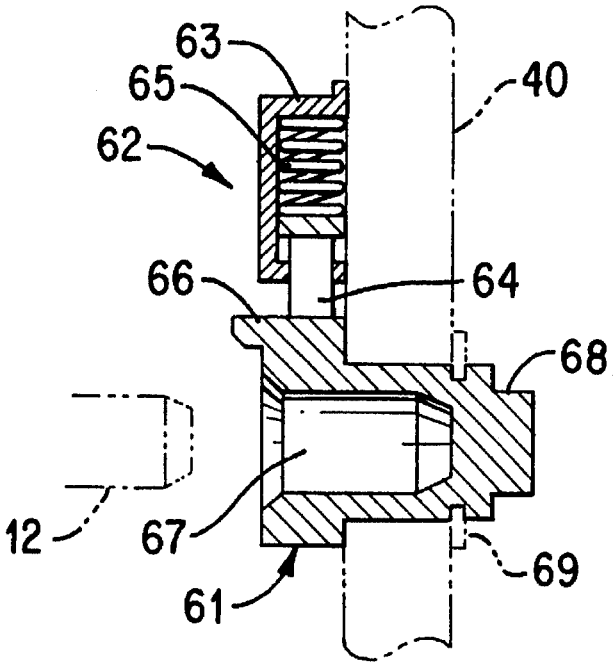
FIG. 5 is a sectional view taken along the line A—A in FIG. 4.

Out of the entire pin fitters 60, a pin fitter 60*a* provided in the support side plate 40 is formed into a cam mechanism where its fitting base 61*a* has a cam lobe 66 as illustrated in FIGS. 4 and 5. The fitting base 61*a* is so held that the whole thereof is rotatable bidirectionally as indicated by an arrow B, whereby the position of the cam lobe 66 can be displaced. In FIG. 5, there are further shown a cavity 67 into which the engagement pin 12 is fitted, a hexagon head 68 for rotating the fitting base 61*a* by means of a hexagon wrench or the like, and a lock ring 69 for locking the fitting base 61 fixedly to the support side plate 40.

Figure 6:
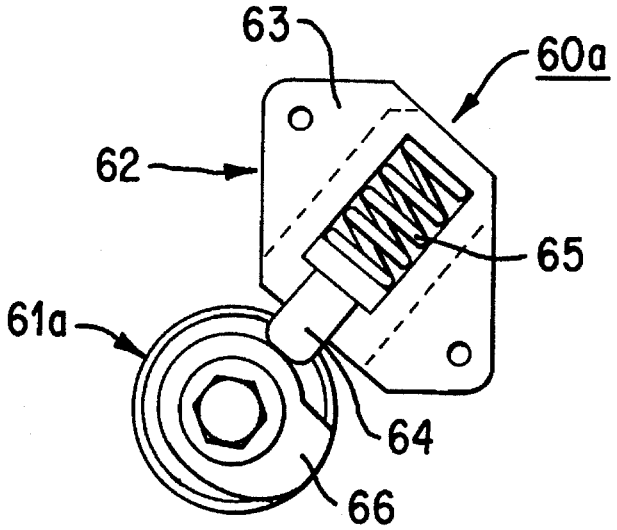
FIG. 6 is a front view showing the pin fitter of FIG. 4 in a released state.

Accordingly, the pin fitter 60 is so actuated that, when the cam lobe 66 is displaced to be opposite to the push rod 64 of the pressure jig 62 by rotating the fitting base 61*a* as illustrated in FIG. 4, the fitting base 61*a* is pressed by the pressure jig 62. Meanwhile, if the cam lobe 66 is displaced to another position not opposite to the push rod 64 of the pressure jig 62 by rotating the fitting base 61*a* as illustrated in FIG. 6, the fitting base 61*a* is held in a state free from the pressure of the jig 62, i.e., in a state released from the pressure.

In the apparatus represented by the embodiment of the above construction, the four unicolor imaging units 10*a*–10*d* are installed in the apparatus body in the following manner.

First, each unicolor imaging unit 10 equipped with the aforementioned developing device 2, cleaner 3 and photosensitive drum 4 is set in the apparatus body by means of prepared slide rails 30. Specifically, the movable rails 30*b* on the imaging unit side are inserted into the stationary rails 30*a* on the apparatus body side from the front of the apparatus, and then the imaging unit is pushed along the rails 30*a* up to a predetermined position.

When the imaging units 10 are set in the apparatus body by means of the slide rails 30, the photosensitive drum 4 incorporated in each imaging unit is positioned as the shaft 5 attached previously to the shaft fitter 50 in the rear frame 20*b* of the apparatus body is inserted into the shaft hole formed in the drum 4. In this stage of the installation, the shaft 5 of the photosensitive drum 4 in the rear of each unicolor imaging unit 10 and the engagement pin 12 of the unit frame 1 are fitted respectively into the shaft fitter 50 and the pin fitter 60 provided in the rear frame 20*b* of the apparatus body.

Figure 7:
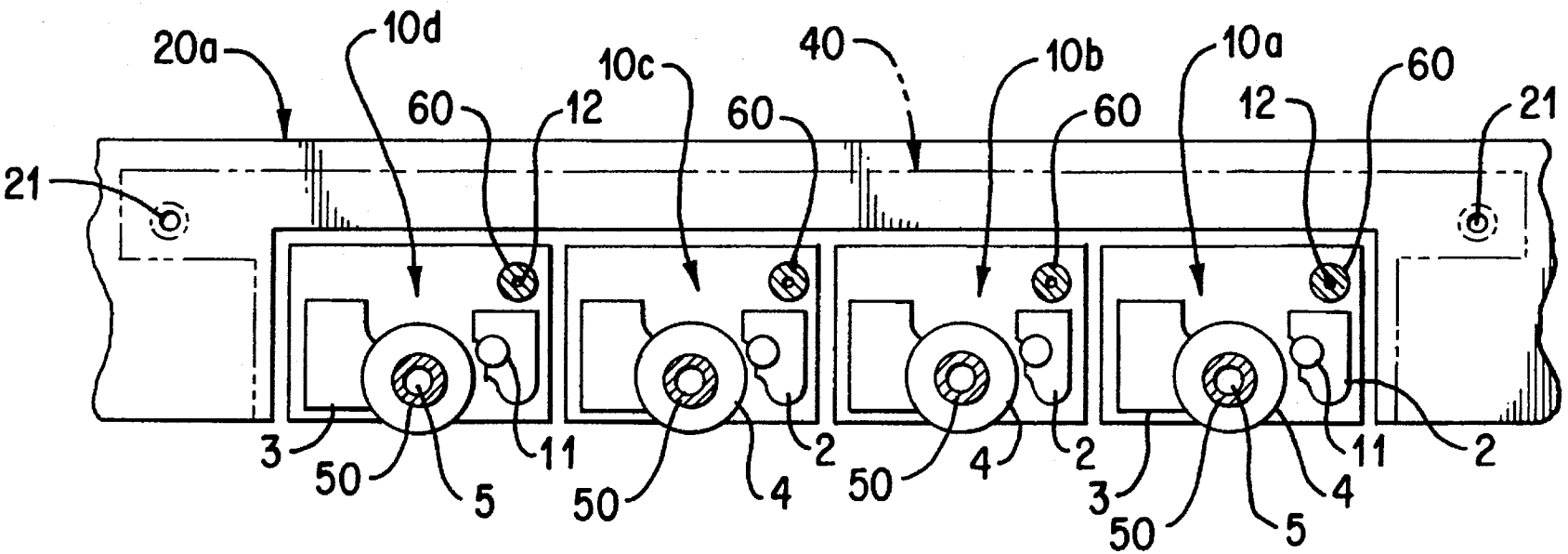
FIG. 7 is a front explanatory diagram illustrating how unicolor imaging units are installed in the apparatus body.

In this stage, the unicolor imaging units 10*a*–10*d* are installed in the apparatus body with an arrangement of a predetermined order, as illustrated in FIG. 7. And the shaft 5 is set with respect to the photosensitive drum 4 in each imaging unit 10, as shown in FIG. 1.

Subsequently, the support side plate 40 is anchored at a predetermined position of the front frame 20*a* of the apparatus body (FIG. 7). That is, as shown in FIG. 1, an engagement hole 42 formed in the support side plate 40 is fitted and locked to the engagement pin 21 projecting from a predetermined position of the front frame 20*a*, whereby the support side plate 40 is fixed to the front frame 20*a*. And simultaneously therewith, the shaft 5 of the photosensitive drum 4 and the engagement pin 12 of the unit frame 1 projecting from the surface of the unit frame 1 in the front of each imaging unit 10 are fitted respectively into the shaft fitter 50 and the pin fitter 60*a* provided in the support side plate 40.

Contrary to the above, when the four unicolor imaging units 10*a*–10*d* are removed from the apparatus body, the foregoing procedure may be executed in the reverse order. More specifically, each imaging unit 10 can be removed by first detaching the support side plate 40 from the front frame 20*a* of the apparatus body, and then drawing out each imaging unit 10 from the apparatus body along the slide rails 30.

In installing or removing the imaging unit 10, further the pin fitting base 61*a* of the support side plate 40 is manipulated in the following manner. First, at the time of installation, the pin fitting base 61*a* is placed in a state released from the pressure of the jig 62 (FIG. 6), and the support side plate 40 is anchored in this state. Thereafter, when the engagement pin 12 of the unit frame 1 has been fitted into the pin fitting base 61*a*, the base 61*a* is rotated to be pressed by the jig 62 (FIG. 4). Meanwhile, at the time of removal, the pin fitting base 61*a* is rotated to be released from the pressure of the jig 62 (FIG. 6), and then the support side plate 40 is detached after drawing out the engagement pin 12 from the pin fitting base 61*a*. Due to such procedures, the operations for installation and removal can be performed simply and smoothly with enhanced facility.

Upon complete installation of the four imaging units 10*a*–10*d* as described, the shafts 5 of the photosensitive drums 4 are fitted respectively into the corresponding shaft fitters 50 (in this embodiment, practically the shaft fitters of the support side plate 40), whereby the photosensitive drums 4 are positioned to the apparatus body. And simultaneously therewith, the engagement pins 12 in the unit frames 1 of the imaging units are fitted respectively into the corresponding pin fitters 60, whereby the developing devices 2 incorporated in the unit frames 1 are positioned to the photosensitive drums 4 already positioned.

Figure 8:
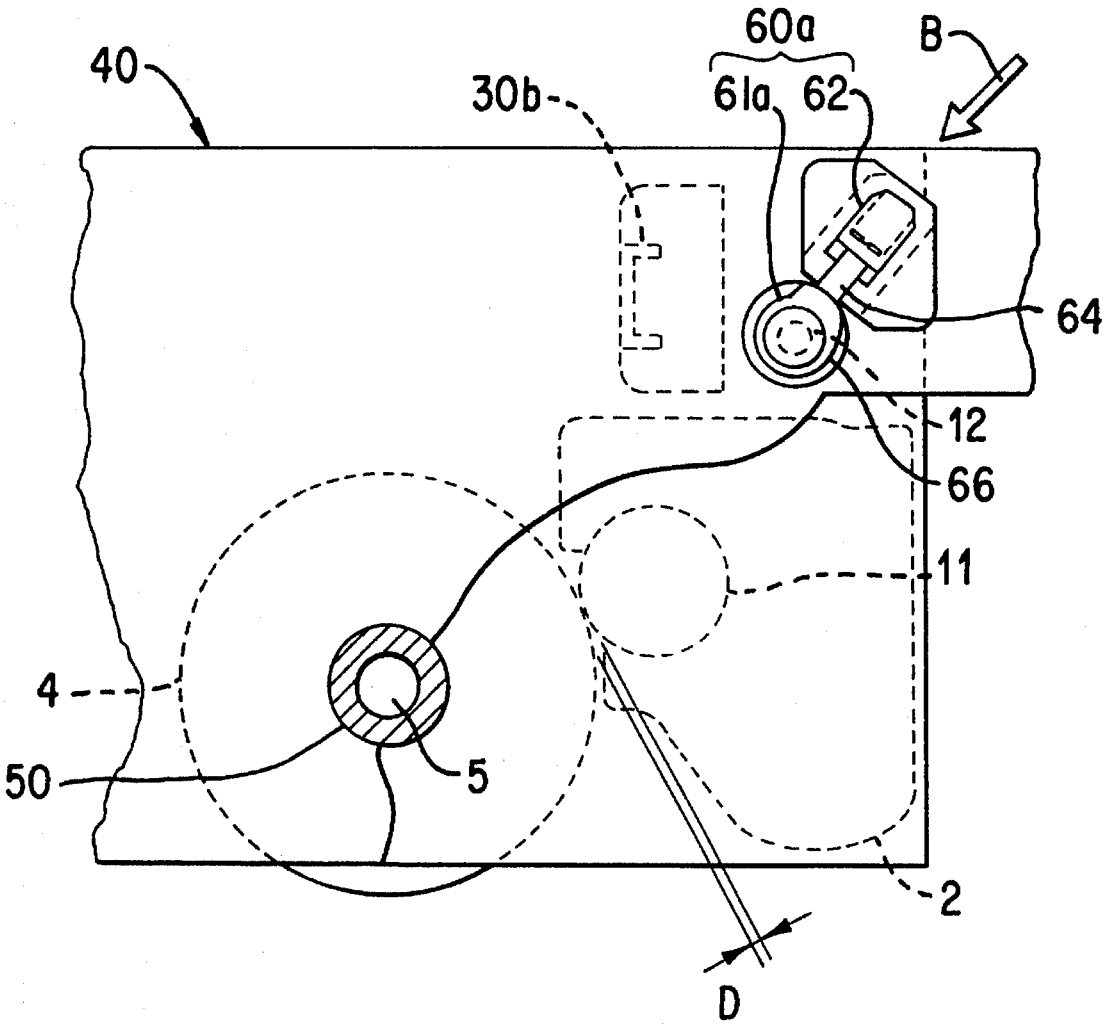
FIG. 8 is a partially cutaway explanatory diagram illustrating how the components are positioned when the unicolor imaging units are installed in the apparatus body.

In particular, when the engagement pin 12 of each imaging unit has been fitted into the corresponding pin fitter 60 as illustrated in FIG. 8, the pin fitter 60 is pushed by a predetermined pressure of the jig 62 toward the shaft fitter 50 (in the direction indicated by an arrow B), so that the developing device 2 in the unit frame 1 furnished with the engagement pin 12 is pressed toward the side where the photosensitive drum 4 is existent. As a result, the gap D between the photosensitive drum 4 and the development roll 11 is maintained at a desired value for development. The pressure applied from the jig 62 at this time is set to, e.g., 3 kgf or so.

Due to such installation of each imaging unit and particularly because of the pressure applied from the jig 62 to the pin fitter 60 in the installation, the gap D between the photosensitive drum 4 and the development roll 11 can always be retained within a desired range of 0.45±0.03 mm for development. In any other case where such installation is not performed or none of the pressure mechanism is employed, the gap D is rendered greater than 0.45±0.1 mm.

In the apparatus of this embodiment, toner images produced by an electrophotographic process or the like on the photosensitive drums 4 of the four imaging units 10a-10d installed in the apparatus body are successively transferred onto a recording paper P transported by means of a conveyor belt or the like which is disposed opposite to the imaging units and is rotated thereunder as illustrated in FIG. 1. Consequently, a color image is formed on the recording paper P by such multiple transfers. Then the recording paper P after completion of the multiple image transfers is transported for execution of posterior processing steps inclusive of fixing and so forth, and finally the recording paper is conveyed to an outlet tray or the like disposed outside the apparatus.

The preferred embodiment mentioned above illustratively represents an exemplary construction where the shaft 5 of each photosensitive drum 4 is inserted into the drum in a manner to be drawn out therefrom and is previously attached to the apparatus body. However, it is to be understood that the present invention is not limited to such a construction alone, and the shaft 5 may be united integrally with the photosensitive drum 4.

In the multicolor image forming apparatus of the present invention, as described hereinabove, a plurality of unicolor imaging units are installed in the apparatus body through slide rails, then the support side plate is anchored to the front frame of the apparatus body, and the shafts of image carrier drums in the imaging units and the engagement pins of unit frames are fitted respectively into the shaft fitters and the pin fitters, whereby the unicolor imaging units can be installed in or removed from the apparatus body with facility. And particularly in installing the imaging units, the image carrier drums and the developing devices can always be positioned exactly with ease and certainty.

When the engagement pin of each unit frame is fitted into the pin fitter with the pin fitting base thereof being pressed by the jig, the imaging unit can be installed properly in a state where the gap between the image carrier drum and the development roll can be retained constant with enhanced accuracy. Furthermore, the operation for installation and removal of each imaging unit can be performed simply with remarkable convenience by adequately manipulating the pin fitting base of a cam mechanism in the support side plate.

According to the present invention, therefore, the image carrier drums and the developing devices are exactly positioned at the time of installation of the plural unicolor imaging units, so that a satisfactory multicolor image can be formed without any color deviation or any image density unevenness that may otherwise be caused by dimensional variations of the development gap. In addition, such exact positioning can be achieved stably despite frequent repetition of the installation and removal of the unicolor imaging units without the necessity of employing the aforementioned tracking member. Consequently, it becomes possible to eliminate the known requisite of strictly maintaining the extremely high precision relative to the dimensions of individual component parts and also in assembling and setting such component parts, hence curtailing the cost of the component parts and averting difficulty in handling the same.

What is claimed is:

1. A multicolor image forming apparatus comprising:

a plurality of unicolor imaging units each equipped with at least a developing device anchored to a unit frame and an image carrier drum anchored removably to said unit frame, each of said unicolor imaging units being installed removably in an apparatus body;

slide rails attached to a front frame and a rear frame of the apparatus body to support said unicolor imaging units, so that toner images produced individually by said unicolor imaging units transferred onto a recording medium form a multicolor image; and a shaft fitter receiving a shaft of the image carrier drum in each of said unicolor imaging units and a pin fitter receiving an engagement pin projecting from said unit frame are provided in the rear frame of said apparatus body and a support side plate, respectively;

wherein said pin fitter comprises a pin fitting base and a pressure jig that presses said pin fitting base toward said shaft fitter to maintain a predetermined space between said shaft fitter and said pin fitter, said support side plate being removably anchored to a predetermined position of the front frame of said apparatus body.

2. The multicolor image forming apparatus according to claim 1, wherein the pin fitting base of said pin fitter provided in said support side plate is a cam mechanism rotatable for releasing the pressure of said pressure jig.

3. The multicolor image forming apparatus according to claim 2, wherein the pressure jig comprises:

a jig housing anchored to one of the rear frame of the apparatus body and the support side plate;

a push rod within a housing that reciprocates in a predetermined direction; and a coil spring for resiliently urging the push rod in the predetermined direction.

4. The multicolor image forming apparatus according to claim 2, wherein the cam mechanism includes a cam lobe extending from the pin fitting base, the cam lobe rotating between a first position receiving pressure from a push rod of the pressure jig and a second position released from pressure of the pressure jig.

5. The multicolor image forming apparatus according to claim 1, wherein a predetermined uniform distance is maintained between a developing roller of said developing device and the image carrier drum of each of said plurality of unicolor imaging units.

6. The multicolor image forming apparatus according to claim 1, wherein the pin fitting base is composed of one of a metallic material and a synthetic resin.

7. The multicolor image forming apparatus according to claim 1, wherein the shaft fitter in the support side plate is opposite a corresponding shaft fitter in the rear frame when the support side plate is anchored to the front frame of said apparatus body.

8. A multicolor image foreign apparatus according to claim 1, wherein the pin fitter in the support side plate is opposite a corresponding pin fitter in the rear frame when the support side plate is anchored to the front frame of the apparatus body.

9. A method for using a multicolor image forming apparatus comprising the steps of:

attaching stationary rails between a front frame and a rear frame of an apparatus body;

supporting a plurality of unicolor imaging units using movable rails;

positioning the unicolor imaging units in the apparatus body by inserting the movable rails into the stationary rails, wherein each of the plurality of unicolor imaging units includes at least a developing device, a cleaner, at least one engaging pin and a photosensitive drum;

connecting a shaft of the photosensitive drum to a shaft fitter and a rear engaging pin of the unit frame into a pin fitter provided in the rear frame of the apparatus body;

anchoring a support side plate to a predetermined position of the front frame of the apparatus body and simultaneously connecting the shaft of the photosensitive drum into a shaft fitter in the support side plate and a front engaging pin of the unit frame into a pin fitter in the support side plate; and moving both the pin fitter in the rear frame and support side plate to an engaged position, the pin fitter comprising a pin fitter base and a pressure jig for pressing the pin fitting base toward a corresponding shaft fitter in the engaged position.

10. The method according to claim 9, further comprising the steps of:

moving the pin fitter in the rear frame and the support side plate out of the engaged position;

detaching the support side plate from the front frame of the apparatus body;

disconnecting the photosensitive drum shaft from the shaft fitter and the engaging pin from the pin fitter; and replacing at least one of the plurality of imaging units from the apparatus body.

11. The method according to claim 9, wherein the pin fitting base of the pin fitter provided in the support side plate is a cam mechanism rotatable between an engaged position receiving pressure from the pressure jig and an unengaged position released from the pressure of the pressure jig.

* * * * *